US007882870B2

(12) United States Patent
Lee

(10) Patent No.: US 7,882,870 B2
(45) Date of Patent: Feb. 8, 2011

(54) PORTABLE SUPPORTING FRAME FOR CUTTING MACHINE

(76) Inventor: Wy Peron Lee, 11722 Warm Springs Rd., Riverside, CA (US) 92505

( * ) Notice: Subject to any disclaimer, the term of this patent is extended or adjusted under 35 U.S.C. 154(b) by 143 days.

(21) Appl. No.: 12/313,818

(22) Filed: Nov. 24, 2008

(65) Prior Publication Data

US 2009/0133780 A1 May 28, 2009

Related U.S. Application Data

(60) Provisional application No. 61/004,136, filed on Nov. 23, 2007.

(51) Int. Cl.
*B25H 1/00* (2006.01)

(52) U.S. Cl. ..... 144/286.1; 144/287; 280/40; 280/47.18; 280/47.24; 280/47.29

(58) Field of Classification Search ..... 144/286.1–287; 280/38–40, 640, 641, 645, 651, 652, 47.18, 280/47.24, 47.27, 47.28, 47.29; 83/471, 83/474

See application file for complete search history.

(56) References Cited

U.S. PATENT DOCUMENTS

| | | | | |
|---|---|---|---|---|
| 5,067,535 | A * | 11/1991 | Wolff | 144/286.1 |
| 6,578,856 | B2 * | 6/2003 | Kahle | 280/30 |
| 6,942,229 | B2 * | 9/2005 | Brazell et al. | 280/30 |
| 7,086,434 | B2 * | 8/2006 | Lee | 144/286.1 |
| 7,213,829 | B2 * | 5/2007 | Wu | 280/645 |
| 7,222,865 | B2 * | 5/2007 | Chen et al. | 280/30 |
| 7,464,956 | B2 * | 12/2008 | Chen et al. | 280/639 |
| 7,690,408 | B2 * | 4/2010 | Sugiura | 144/286.5 |

* cited by examiner

*Primary Examiner*—Shelley Self
(74) *Attorney, Agent, or Firm*—Raymond Y. Chan; David and Raymond Patent Firm

(57) ABSTRACT

A portable supporting frame for a cutting machine includes a leg frame, a tabletop frame, and a frame locker. The leg frame includes two opposing pairs of first and second supporting legs. The tabletop frame includes two table arms pivotally connected to the first crossed legs respectively. The frame locker is used for locking the top ends of the second crossed legs to the table arms respectively to retain the portable supporting frame at a set up position. When the frame locker is released, the tabletop frame is adapted to pivotally fold at 180° to overlap on the folded leg frame at a folded position.

17 Claims, 6 Drawing Sheets

PORTABLE SUPPORTING FRAME FOR CUTTING MACHINE

CROSS REFERENCE OF RELATED APPLICATION

This is a non-provisional application of a provisional application having an application No. 61/004,136 and a filing date of Nov. 23, 2007.

BACKGROUND OF THE PRESENT INVENTION

1. Field of Invention

The present invention relates to a table frame, and more particularly to a portable supporting frame for cutting machine, which is capable of being quickly and easily folded for carriage and storage and unfolded for supporting the cutting machine.

2. Description of Related Arts

A conventional cutting machine is commonly used in the construction industry for shaping and cutting materials such as ceramic tile, marble, granite, and natural stone. The conventional cutting machine usually comprises a cutting table supported on a supporting frame, four construction posts positioned at four corners of the supporting frame, a cutting head overhanging the cutting table with a circular saw blade which is powered by an electric motor. The electric motor is directly mounted on the cutting head for driving the saw blade to rotate through a transmission means.

Accordingly, the conventional cutting machine further comprises a floor standing frame which comprises a set of four standing legs detachably connected with the four construction posts respectively by a connecting bolt for supporting the cutting machine on a floor. During transportation or storage, a user may detach the four standing legs by pulling them out from four construction posts after unscrewing the connecting bolts.

However, the conventional floor standing frame for supporting the cutting machine includes some following drawbacks:

Firstly, the cutting head comprises a motor and a transmission means positioned above the supporting frame, wherein the floor standing frame must support the heavy weight of the cutting head. In fact, the four-leg structure of the floor standing frame is weak structure to support the heaving weight. Therefore, the four standing legs of the floor standing frame must be made of strong material such as cast iron or steel alloy can be securely fastened to the four construction posts in order to rigidly support the heavy cutting head.

Secondly, the floor standing frame requires assembly or disassembly to use or store. The floor standing frame is detachably attached on the supporting by means of the four standing legs can be detached from the four construction posts of the supporting frame respectively. So, the user must assemble the floor standing frame when the cutting machine is needed to be used and disassemble the four standing legs from the supporting frame after using the cutting machine.

Thirdly, the floor standing frame, which is constructed by several parts, includes four standing legs and several connecting bolts. When the floor standing frame is disassembled for transportation or storage, the user must carry or store all the several parts of the floor standing frame because it is easy to loss one of the parts.

Fourthly, when the floor standing frame is assembled for use, the user must need a tool to attach the floor standing frame to the supporting frame so as to connect the standing legs to the construction posts by screwing the connecting bolts. Likewise, the user must use a tool to unscrew the connecting bolts in order to detach the standing legs from the construction posts when disassembling the floor standing frame.

Additional, when the floor standing frame is disassembled for carriage or displace, the user rather need an exhaust work to carriage or displace the frame made of strong material to the required place. Hereby, exterior conveyance is used for carrying or displacing the disassembled floor standing frame.

SUMMARY OF THE PRESENT INVENTION

A main object of the present invention is to provide a portable supporting frame for a cutting machine, which is capable of being quickly and easily folded for carriage and storage and unfolded for supporting the cutting machine.

Another object of the present invention is to provide a portable supporting frame for a cutting machine, which does not require assembly or disassembly to use or store.

Another object of the present invention is to provide a portable supporting frame for a cutting machine, which can be used in any location without using tools for its assembly or disassembly.

Another object of the present invention is to provide a portable supporting frame for a cutting machine, which can be easily carried or displaced to a required place.

Another object of the present invention is to provide a portable supporting frame for a cutting machine, which is simple in structure with inexpensive manufacture and maintenance cost.

Accordingly, in order to accomplish the above objects, the present invention provides a portable supporting frame for cutting machine, comprising:

a leg frame comprising two pairs of supporting legs each of which comprises a pair of first and second crossed legs pivotally and crossly connected together;

a tabletop frame comprising two table arms pivotally connected to top ends of the first crossed legs respectively, wherein the tabletop frame is adapted to pivotally fold between a set up position and a folded position; and a frame locker comprising two locker joints provided at top ends of the second crossed legs and two locking members arranged in such a manner that when the second crossed legs are pivotally folded at a setup position, the locker joints are coupled with the first and second table arms respectively, such that the locking members are engaged with the locker joints respectively to lock up the second crossed legs with the first and second table arms respectively, so as to retain the leg frame at the set up position.

Accordingly, when the locking members are disengaged with the locker joints respectively, the tabletop frame is pivotally folded at 180° to overlap on the leg frame so as to fold up the portable supporting frame at the folded position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
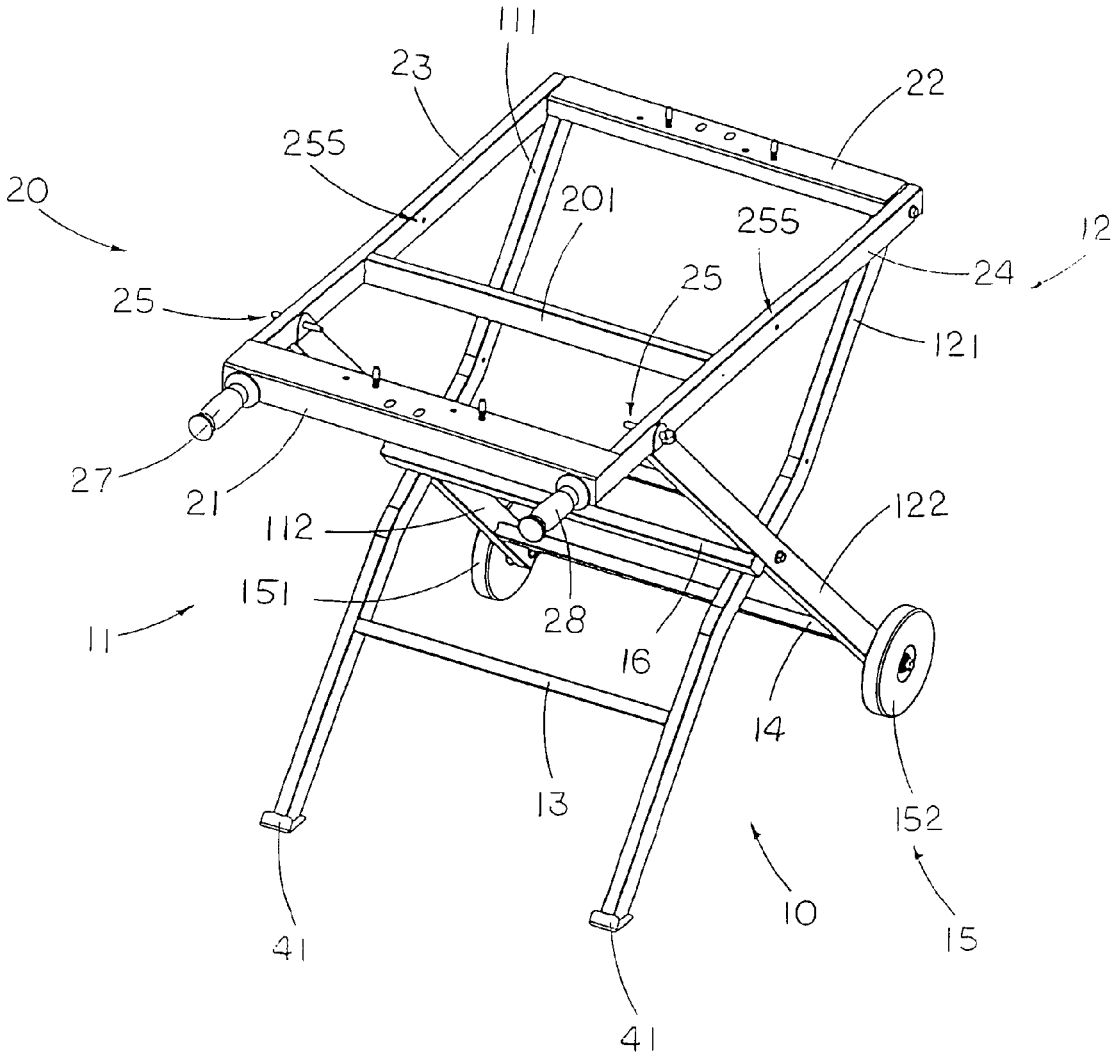
FIG. 1 is a perspective view of a portable supporting frame for a cutting machine according to a preferred embodiment of the present invention, illustrating the portable supporting frame being unfolded in a working state.
Figure 2:
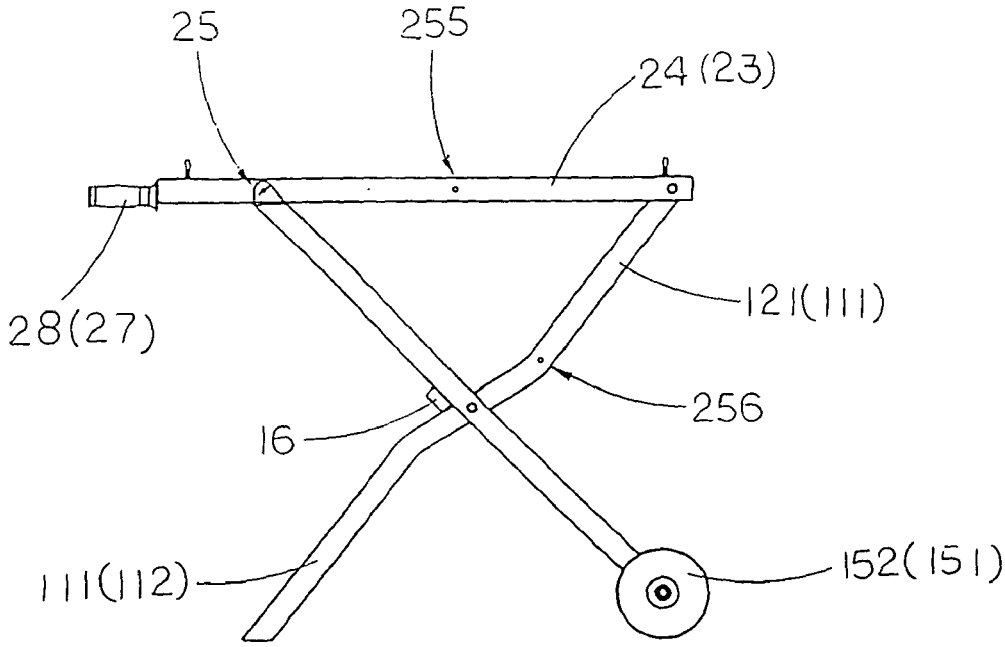
FIG. 2 is a side view of the portable supporting frame for the cutting machine according to the above preferred embodiment of the present invention.
Figure 3:
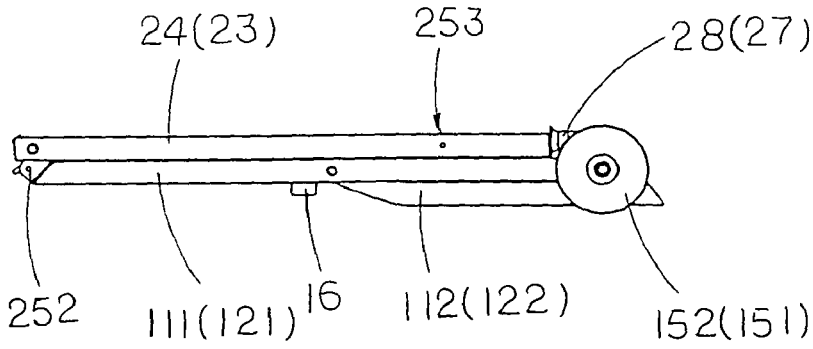
FIG. 3 is a side view of the portable supporting frame for the cutting machine according to the above preferred embodiment of the present invention, illustrating the portable supporting frame being folded in a carriage state.

Referring to FIGS. 1, 2 and 3 of the drawings, a portable supporting frame for a cutting machine, according to a preferred embodiment of the present invention is illustrated, in which the portable supporting frame comprises a leg frame 10 and a tabletop frame 20.

The leg frame 10 comprises two opposing pairs of supporting legs 11, 12, two linking member 13, 14 and a transportation unit 15. Each of the two opposing pairs of supporting legs 11, 12 comprises a pair of first and second crossed legs 111, 112, 121, 122 pivotally and crossly connected together. The two linking member 13, 14 are a first linking member 13 for supporting the two first crossed legs 111, 121 in parallel manner and a second linking member 14 for supporting the two second crossed legs 112, 122 in parallel manner. In other words, the first linking member 13 is perpendicularly extended between the two first crossed legs 111, 121, while the second linking member 14 is perpendicularly extended between the two second crossed legs 112, 122. The transportation unit 15 comprises first and second wheel units 151, 152 respectively provided at bottom ends of the two second crossed legs 112, 122 for carrying or displacing the portable supporting frame to a required place when the portable supporting frame is in a folded and carriage manner.

The leg frame 10 comprises two stop holders 41 affixed to bottom ends of the first crossed legs 111, 121 respectively for steadily setting up the leg frame 10 on the ground.

The tabletop frame 20 comprises first and second supporting arms 21, 22, first and second table arms 23, 24 and a frame locker 25. The first supporting arm 21 is extended to parallel to the second supporting arm 22, wherein the second supporting arm 22 has two ends rotatably coupled with two top ends of the first crossed legs 111, 121 respectively. The first table arm 23 is extended to parallel to the second table arm 24, wherein the two corresponding ends of the first and second table arms 23, 24 are pivotally coupled with the two top ends of the first crossed legs 111, 121 respectively. Another two opposed ends of the first and second table arms 23, 24 are coupled with two ends of the first supporting arm 21 respectively, such that the first and second supporting arms 21, 22 and the first and second table arms 23, 24 form a rectangular structure to pivotally connect to the leg frame 10, so as to support the cutting machine on the tabletop frame 20. A third supporting arm 201 is perpendicularly extended between the first and second table arms 23, 24, wherein the third supporting arm 201 is extended parallel between the first and second supporting arms 21, 22.

Figure 4:
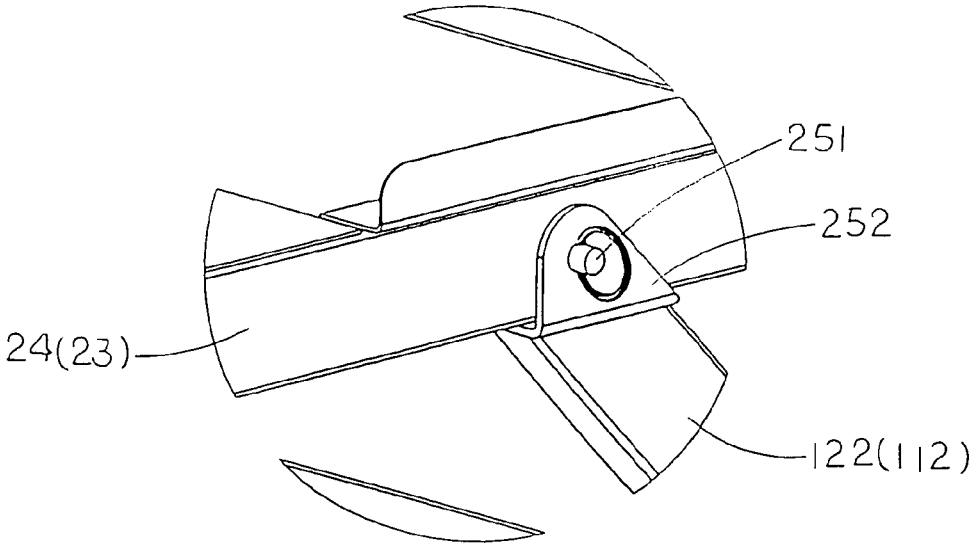
FIG. 4 is a perspective view of the folding joint of the portable supporting frame according to the above preferred embodiment of the present invention, illustrating the folding joint being set up at the working state.
Figure 5:
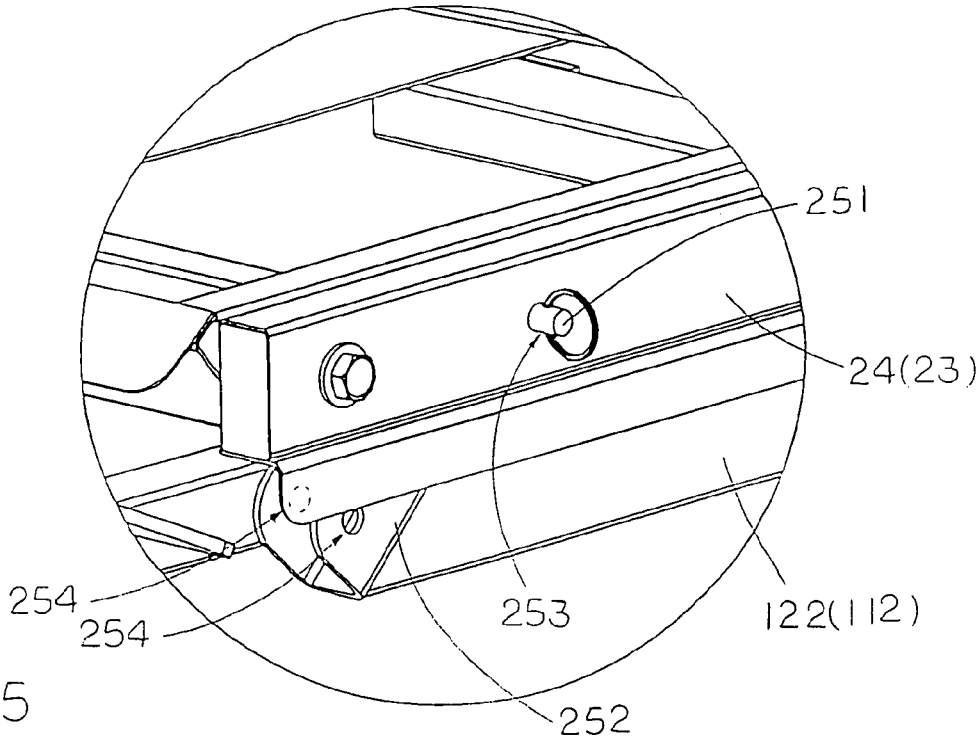
FIG. 5 is a perspective view of the folding joint of the portable supporting frame according to the above preferred embodiment of the present invention, illustrating the folding joint being set up at the carriage state.

The frame locker 25 comprises two locker joints 252 provided at the two top ends of the second crossed legs 112, 122 respectively, and two elongated locking members 251 arranged in such a manner that when the second crossed legs 112, 122 are pivotally folded at a setup position, as shown in FIGS. 1 and 2, the locker joints 252 are coupled with the first and second table arms 23, 24 respectively, such that the locking members 251 are engaged with the locker joints 252 respectively to lock up the second crossed legs 112, 122 with the first and second table arms 23, 24 respectively, as shown in FIG. 4. When the locking members 251 are disengaged with the locker joints 252 respectively, the second crossed legs 112, 122 are unlocked with the first and second table arms 23, 24 respectively, such that the leg frame 10 is adapted to be pivotally folded at a folded position, as shown in FIGS. 3 and 5. It is worth to mention that when the portable supporting frame is folded at the folded position, the second crossed legs 112, 122 are pivotally folded underneath the first and second table arms 23, 24 while the first crossed legs 111, 121 are pivotally folded inside the second crossed legs 112, 122 respectively, as shown in FIG. 3.

The frame locker 25 contains two locker slots 253 transversely provided at the first and second table arms 23, 24. Accordingly, each of the locker slots 253 is located at the respective table arm 23, 24 at a position that the locker joint 252 is engaged with the table arm 23, 24.

As shown in FIGS. 4 and 5, each of the locker joints 252, having a U-shaped cross section, comprises two parallel locker walls and two locker holes 254 provided thereon respectively. A distance between the two locker walls is slightly larger than a thickness of each of the first and second table arms 23, 24, wherein the locker joints 252 forms two arm seats to receive the first and second table arms 23, 24 respectively that each of the first and second table arms 23, 24 is supportively retained between the two corresponding locker walls. In addition, each of the locker slots 253 is coaxially aligned between the locker holes 254 such that the respective locking member 251 is adapted to pass through the two locker holes 254 through the locker slot 253 to lock up the second crossed leg 112, 122 with the respective first and second table arm 23, 24.

As shown in FIGS. 2 and 3, the frame locker 25 further contains two first retention slots 255 transversely provided at the table arms 23, 24 and two second retention slots 256 transversely provided at the first crossed legs 111, 121, wherein when the leg frame 10 is folded at the folded position, the first crossed legs 111, 121 are received at inner sides of the table arms 23, 24 to align the first retention slots 255 with the second retention slots 256 respectively, such that the locking members 251 are extended through the second retention slots 256 through the first retention slots 255 to lock up the leg frame 10 with the tabletop frame 20 at the folded position.

Hereby, by pivotally rotating the two second crossed leg 112, 122 and engaging the locker joints 252 with the locking members 251, the portable supporting frame is ready in the unfolded and setup manner, and by disengaging the locker joint 252 with the locking member 251 and dropping down the tabletop frame 20 to vertically overlap with the folded leg frame 10, the entire portable supporting frame is in the folded and carriage manner to be moved easily through the transportation unit.

According to the preferred embodiment of the present invention, as shown in FIG. 2 of the drawings, the first and second crossed legs 111, 112, 121, 122 of the two opposing pairs of supporting legs 11, 12 are connected in a pivot point. Two fasten members, such as two rivets, are used to pivotally connect the first and second crossed legs 111, 112, 121, 122 of the two supporting legs 11,12 respectively such that the first and second crossed legs 111, 112, 121, 122 are arranged to be pivoted along the fasten member in a scissors-like manner.

The leg frame 10 further comprises a stopper arm 16 having two ends coupled with the second crossed legs 112, 122 to bias against the first crossed legs 111, 121 at the set up position so as to stop the further pivot movement of each of the first crossed legs 111, 121 at the set up position. In other words, the stopper arm 16 is a stopper to retention the leg frame 10 at the set up position.

Therefore, the leg frame 10 is foldable. The leg frame 10 is able to be unfolded to a unfolded and setup manner in which each of the two supporting legs 11, 12 can be unfolded to form a rigid "X" structure to support the tabletop frame 10 as shown in FIG. 1, or be folded to a folded and carriage manner to be ready for moving easily through the transportation unit 15 as shown in FIG. 3. It is worth to mention that when the portable supporting frame of the present invention is folded at the folded position, the tabletop frame 20 is pivotally folded 180° such that the tabletop frame 20 is pivotally folded upside-down at the folded position.

According to the preferred embodiment of the present invention, as shown in FIGS. 4 and 5 of the drawings, the frame locker 25 is a pin-connection unit, wherein the locking member 251 is a detachable pin-structure locker to steadily lock the top end of each of the first and second crossed legs 121, 122 to the respective table arm 23, 24. In other words, the detachable pin-structure locker of the locking member 251 is slidably passing through the two locker holes 254 of the respective locker joint 252 through the respective second crossed leg 122 to lock up the locker joint 252 at the respective second crossed leg 122.

The leg frame 10 further comprises two drive handles 27, 28 perpendicularly extended from the two ends of the first supporting arm 21 respectively and parallely extended to the first and second table arms 23, 24 respectively. Therefore, when folded in a folded and carriage manner, the whole portable supporting frame can be driven like a cart.

Figure 6:
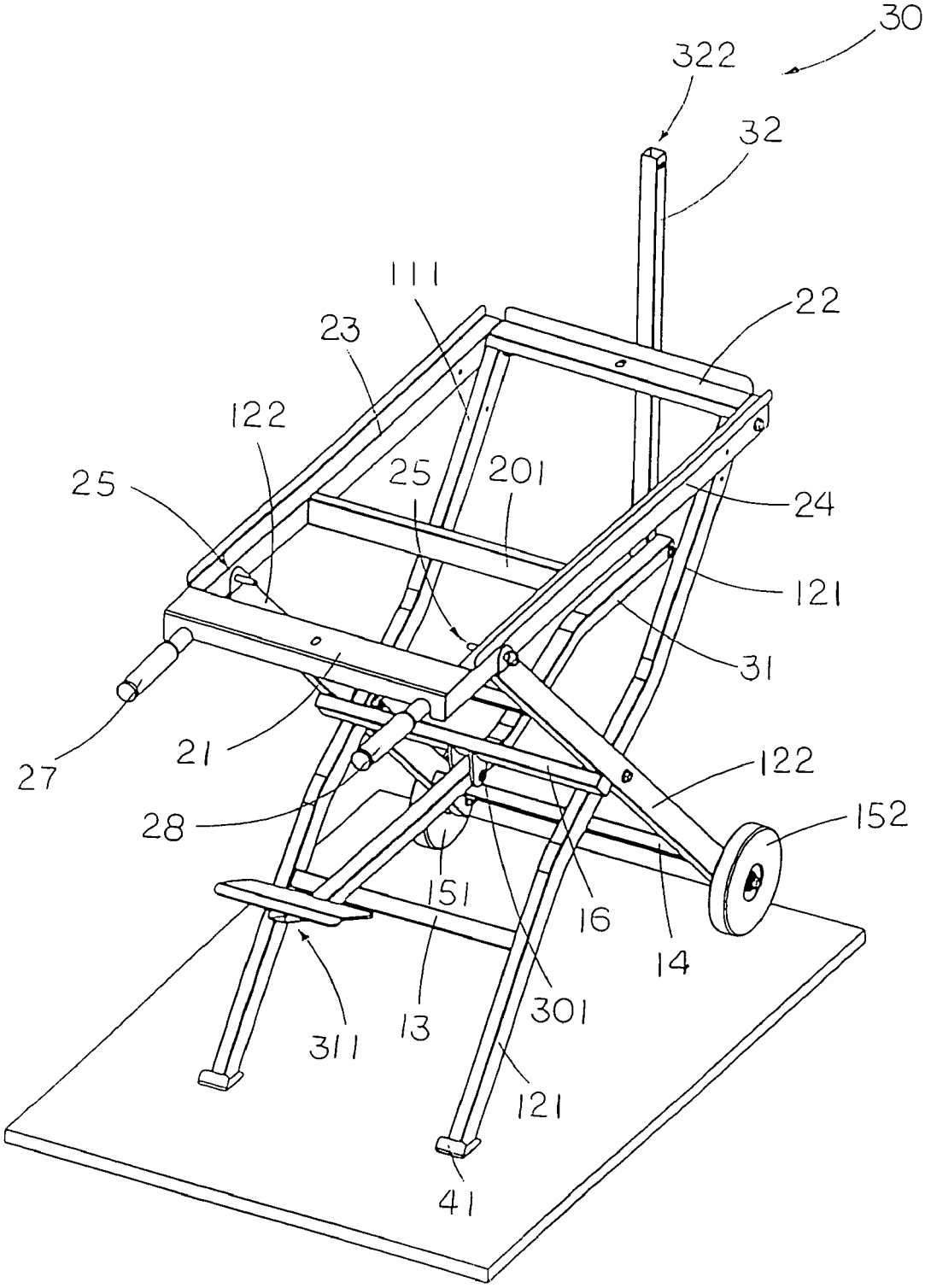
FIG. 6 is a perspective view of a portable supporting frame for the cutting machine according to the above preferred embodiment of the present invention, illustrating a workpiece retention arrangement being mounted to the portable supporting frame.
Figure 7:
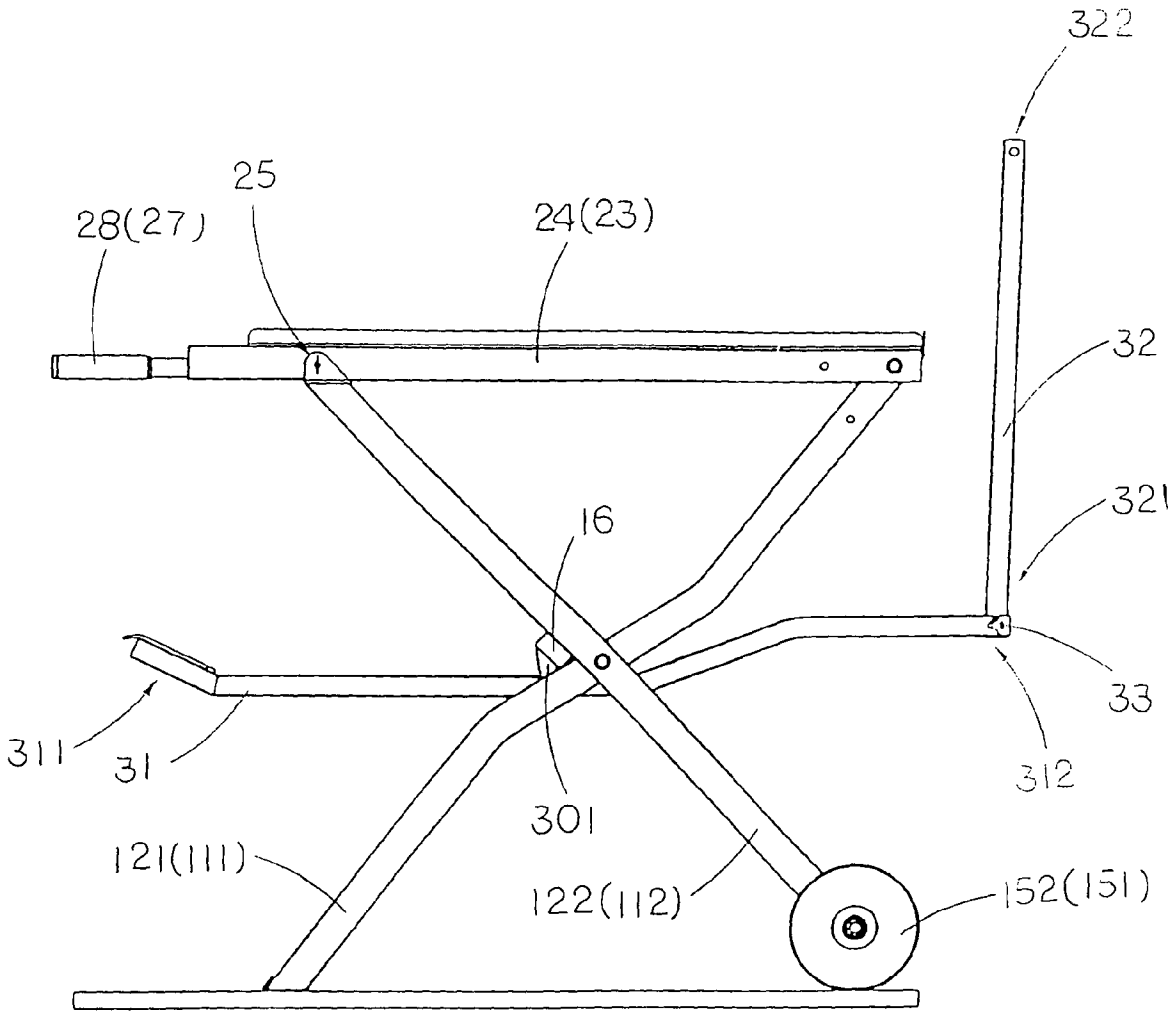
FIG. 7 is a side view of the portable supporting frame with the workpiece retention arrangement according to the above preferred embodiment of the present invention, illustrating the portable supporting frame being unfolded in a working state.

Referring to FIGS. 6 to 9 of the drawings, the portable supporting frame further comprises a workpiece retention arrangement 30. The workpiece retention arrangement 30 comprises an elongated control member 31 pivotally coupled with the leg frame 10 at a position below the tabletop frame 20 and an elongated blocking member 32 pivotally coupled with the control member 31 to form an edge boundary of the tabletop frame 20, as shown in FIGS. 6 and 7.

Accordingly, the control member 31 has a control end 311 and an opposed driving end 312, wherein the control member 31 is pivotally coupled with the stopper arm 16 via a pivot hinge 301. Accordingly, the stopper arm 16 not only forms a stopper to retain the first and second crossed legs 111, 112, 121, 122 at the setup position but also forms a support to support the control member 31 underneath the tabletop frame 20. The pivot hinge 301 will also lock up the position of the control member 31 at the leg frame 10 with respect to the tabletop frame 20. Therefore, when the control end 311 of the control member 31 is pressed downwardly, the driving end 312 thereof is pivotally lifted upward. It is worth to mention that the length of the control member 31 is preferably longer than a distance between the first and second supporting arms 21, 22. Otherwise, the driving end 312 of the control member 31 is extended underneath the tabletop frame 20 out of the second supporting arm 22. In addition, the control end 311 of the control member 31 forms a step pedal for the user to press by foot operation.

The blocking member 32 has a driven end 321 pivotally coupled with the driving end 312 of the control member 31 and an opposed free end 322 upwardly extended above the tabletop frame 20, as shown in FIG. 7. A pivot locker 33 is provided to lock up the driving end 312 of the control member 31 with the driven end 321 of the blocking member 32 to retain an angle between the control member 31 and the blocking member 32.

Accordingly, when the cutting machine is supported on the tabletop frame 20, for cutting a workpiece, the workpiece is slid at the direction from the first supporting arm 21 towards the second supporting arm 22. Once the blocking member 32 is set to upwardly extend above the tabletop frame 20, the blocking member 32 will block the workpiece to prevent the workpiece from being slid out of the cutting machine.

Figure 8:
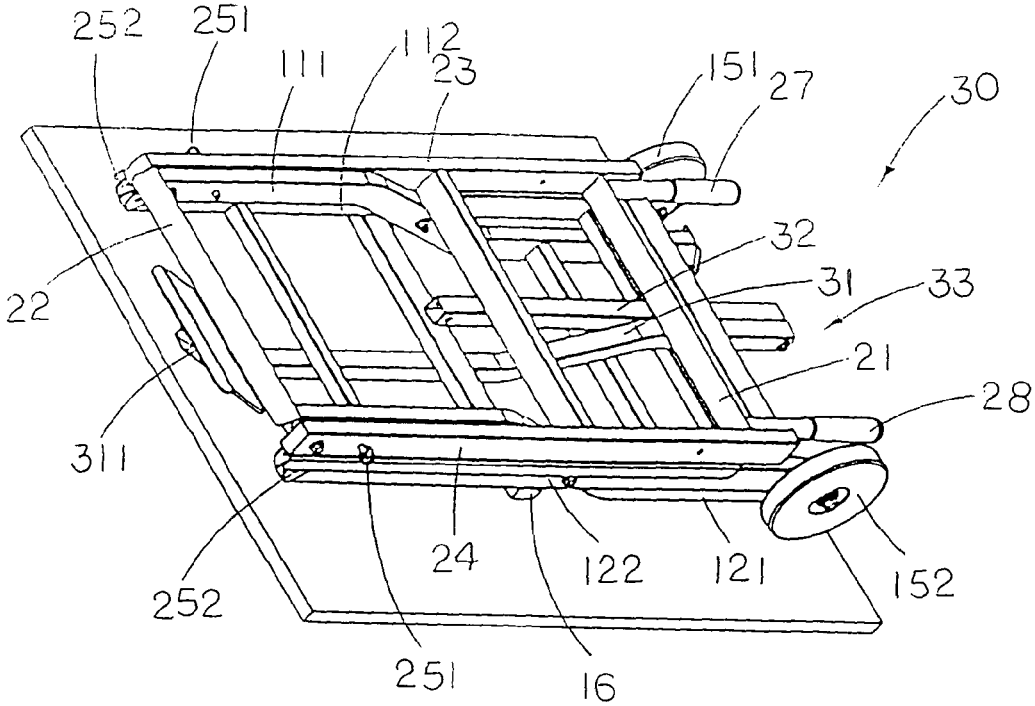
FIG. 8 is a perspective view of the portable supporting frame with the workpiece retention arrangement according to the above preferred embodiment of the present invention, illustrating the portable supporting frame being folded in the carriage state.
Figure 9:
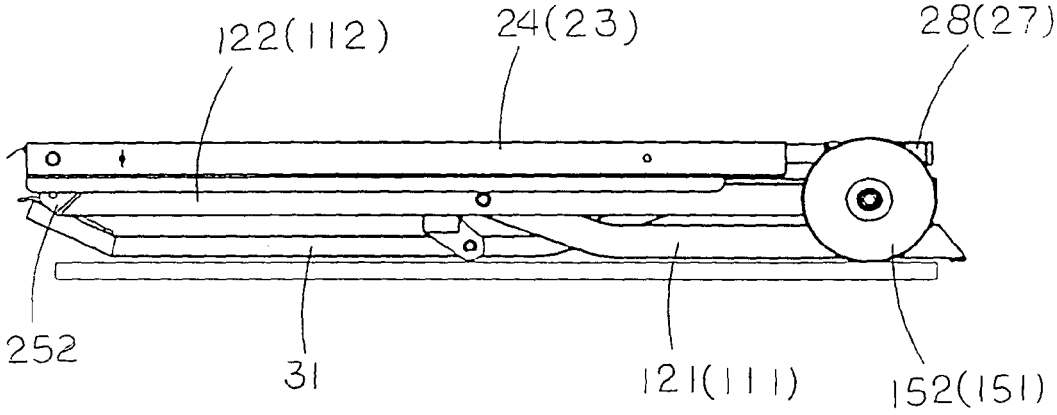
FIG. 9 is a side view of the portable supporting frame with the with the workpiece retention arrangement according to the above preferred embodiment of the present invention, illustrating the portable supporting frame being folded in the carriage state.

According to the preferred embodiment, the leg frame 10 can be folded at the folded position when the leg frame 10 incorporates with the workpiece retention arrangement 30, as shown in FIGS. 8 and 9. When the frame locker 25 is unlocked to release the engagement between the leg frame 10 and the tabletop frame 20, the tabletop frame 20 is upwardly and pivotally folded to allow the blocking member 32 being downwardly and pivotally folded towards the leg frame 10. Therefore, once the tabletop frame 20 is pivotally folded at 180°, the blocking member 32 is positioned between the leg frame 10 and the tabletop frame 20 while the control member 32 is pivotally folded to align with the leg frame 10 as shown in FIGS. 8 and 9.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable supporting frame for a cutting machine, comprising:

a leg frame comprising two pairs of supporting legs each of which comprises a pair of first and second crossed legs pivotally and crossly connected together;

a tabletop frame comprising two table arms pivotally connected to top ends of said first crossed legs respectively, wherein said tabletop frame is adapted to pivotally fold between a set up position for supporting said cutting machine at said tabletop frame and a folded position to form a compact portable unit; and a frame locker comprising two locker joints provided at top ends of said second crossed legs and two locking members arranged in such a manner that when said second crossed legs are pivotally folded at a setup position, said locker joints are coupled with said first and second table arms respectively, such that said locking members are engaged with said locker joints respectively to lock up said second crossed legs with said first and second table arms respectively, so as to retain said leg frame at said set up position, wherein each of said locker joints, having a U-shaped cross section, comprises two parallel locker walls and two locker holes provided thereon respectively, wherein a distance between said two locker walls is slightly larger than a thickness of each of said first and second table arms, such that said locker joints forms two arm seats to receive said respective first and second table arms respectively so as to supportively retain said first and second table arms between said two locker walls.

2. A portable supporting frame for a cutting machine, comprising:

a leg frame comprising two pairs of supporting legs each of which comprises a pair of first and second crossed legs pivotally and crossly connected together;

a tabletop frame comprising two table arms pivotally connected to top ends of said first crossed legs respectively, wherein said tabletop frame is adapted to pivotally fold between a set up position for supporting said cutting machine at said tabletop frame and a folded position to form a compact portable unit; and a frame locker comprising two locker joints provided at top ends of said second crossed legs and two locking members arranged in such a manner that when said second crossed legs are pivotally folded at a setup position, said locker joints are coupled with said first and second table arms respectively, such that said locking members are engaged with said locker joints respectively to lock up said second crossed legs with said first and second table arms respectively, so as to retain said leg frame at said set up position, wherein when said locking members are disengaged with said locker joints respectively, said tabletop frame is pivotally folded at 180° to overlap on said leg frame to fold up said tabletop frame at said folded position, wherein each of said locker joints, having a U-shaped cross section, comprises two parallel locker walls and two locker holes provided thereon respectively, wherein a distance between said two locker walls is slightly larger than a thickness of each of said first and second table arms, such that said locker joints forms two arm seats to receive said respective first and second table arms respectively so as to supportively retain said first and second table arms between said two locker walls.

3. A portable supporting frame for a cutting machine, comprising:

a leg frame comprising two pairs of supporting legs each of which comprises a pair of first and second crossed legs pivotally and crossly connected together;

a tabletop frame comprising two table arms pivotally connected to top ends of said first crossed legs respectively, wherein said tabletop frame is adapted to pivotally fold between a set up position for supporting said cutting machine at said tabletop frame and a folded position to form a compact portable unit, wherein said second crossed legs are pivotally folded underneath said first and second table arms while said first crossed legs are pivotally folded between said second crossed legs respectively to fold said tabletop frame at said folded position; and a frame locker comprising two locker joints provided at top ends of said second crossed legs and two locking members arranged in such a manner that when said second crossed legs are pivotally folded at a setup position, said locker joints are coupled with said first and second table arms respectively, such that said locking members are engaged with said locker joints respectively to lock up said second crossed legs with said first and second table arms respectively, so as to retain said leg frame at said set up position, wherein when said locking members are disengaged with said locker joints respectively, said tabletop frame is pivotally folded at 180° to overlap on said leg frame to fold up said tabletop frame at said folded position, wherein each of said locker joints, having a U-shaped cross section, comprises two parallel locker walls and two locker holes provided thereon respectively, wherein a distance between said two locker walls is slightly larger than a thickness of each of said first and second table arms, such that said locker joints forms two arm seats to receive said respective first and second table arms respectively so as to supportively retain said first and second table arms between said two locker walls.

4. The portable supporting frame, as recited in claim 1, wherein said frame locker contains two locker slots transversely provided at said first and second table arms at a position that when said tabletop frame is folded at said unfolded position, said locker holes are aligned with said locker slots, wherein each of said locking member comprises a detachable pin-structure locker slidably passing through said two locker holes of said respective locker joint through said locker slot of said respective table arm to lock up said locker joint at said respective table arm.

5. The portable supporting frame, as recited in claim 2, wherein said frame locker contains two locker slots transversely provided at said first and second table arms at a position that when said tabletop frame is folded at said unfolded position, said locker holes are aligned with said locker slots, wherein each of said locking member comprises a detachable pin-structure locker slidably passing through said two locker holes of said respective locker joint through said locker slot of said respective table arm to lock up said locker joint at said respective table arm.

6. The portable supporting frame, as recited in claim 3, wherein said frame locker contains two locker slots transversely provided at said first and second table arms at a position that when said tabletop frame is folded at said unfolded position, said locker holes are aligned with said locker slots, wherein each of said locking member comprises a detachable pin-structure locker slidably passing through said two locker holes of said respective locker joint through said locker slot of said respective table arm to lock up said locker joint at said respective table arm.

7. The portable supporting frame, as recited in claim 4, wherein said frame locker contains further contains two first retention slots transversely provided at said table arms and two second retention slots transversely provided at said first crossed legs, wherein when said leg frame is folded at said folded position, said first crossed legs are received at inner sides of said table arms to align said first retention slots with said second retention slots respectively, such that said locking members are extended through said second retention slots through said first retention slots to lock up said leg frame with said tabletop frame at said folded position.

8. The portable supporting frame, as recited in claim 5, wherein said frame locker contains further contains two first retention slots transversely provided at said table arms and two second retention slots transversely provided at said first crossed legs, wherein when said leg frame is folded at said folded position, said first crossed legs are received at inner sides of said table arms to align said first retention slots with said second retention slots respectively, such that said locking members are extended through said second retention slots through said first retention slots to lock up said leg frame with said tabletop frame at said folded position.

9. The portable supporting frame, as recited in claim 6, wherein said frame locker contains further contains two first retention slots transversely provided at said table arms and two second retention slots transversely provided at said first crossed legs, wherein when said leg frame is folded at said folded position, said first crossed legs are received at inner sides of said table arms to align said first retention slots with said second retention slots respectively, such that said locking members are extended through said second retention slots through said first retention slots to lock up said leg frame with said tabletop frame at said folded position.

10. A portable supporting frame for a cutting machine, comprising:

a leg frame comprising two pairs of supporting legs each of which comprises a pair of first and second crossed legs pivotally and crossly connected together;

a tabletop frame comprising two table arms pivotally connected to top ends of said first crossed legs respectively, wherein said tabletop frame is adapted to pivotally fold between a set up position for supporting said cutting machine at said tabletop frame and a folded position to form a compact portable unit;

a frame locker comprising two locker joints provided at top ends of said second crossed legs and two locking members arranged in such a manner that when said second crossed legs are pivotally folded at a setup position, said locker joints are coupled with said first and second table arms respectively, such that said locking members are engaged with said locker joints respectively to lock up said second crossed legs with said first and second table arms respectively, so as to retain said leg frame at said set up position; and a workpiece retention arrangement which comprises an elongated control member, which is pivotally coupled with said leg frame at a position below said tabletop frame, having a control end and an opposed driving end, and an elongated blocking member which is pivotally coupled with said driving end of said control member and is upwardly extended above said tabletop frame to form an edge boundary of said tabletop frame for blocking a workpiece from being slid out of said cutting machine when said cutting machine is supported on said tabletop frame.

11. The portable supporting frame, as recited in claim 6, further comprising a workpiece retention arrangement which comprises an elongated control member, which is pivotally coupled with said leg frame at a position below said tabletop frame, having a control end and an opposed driving end, and an elongated blocking member which is pivotally coupled with said driving end of said control member and is upwardly extended above said tabletop frame to form an edge boundary of said tabletop frame for blocking a workpiece from being slid out of said cutting machine when said cutting machine is supported on said tabletop frame.

12. The portable supporting frame, as recited in claim 9, further comprising a workpiece retention arrangement which comprises an elongated control member, which is pivotally coupled with said leg frame at a position below said tabletop frame, having a control end and an opposed driving end, and an elongated blocking member which is pivotally coupled with said driving end of said control member and is upwardly extended above said tabletop frame to form an edge boundary of said tabletop frame for blocking a workpiece from being slid out of said cutting machine when said cutting machine is supported on said tabletop frame.

13. The portable supporting frame, as recited in claim 10, wherein a length of said control member is longer than a distance between said first and second supporting arms such that said driving end of said control member is extended underneath said tabletop frame out of said second supporting arm, wherein said control end of said control member forms a step pedal to pivotally control said driving end of said control member by foot operation.

14. The portable supporting frame, as recited in claim 11, wherein a length of said control member is longer than a distance between said first and second supporting arms such that said driving end of said control member is extended underneath said tabletop frame out of said second supporting arm, wherein said control end of said control member forms a step pedal to pivotally control said driving end of said control member by foot operation.

15. The portable supporting frame, as recited in claim 12, wherein a length of said control member is longer than a distance between said first and second supporting arms such that said driving end of said control member is extended underneath said tabletop frame out of said second supporting arm, wherein said control end of said control member forms a step pedal to pivotally control said driving end of said control member by foot operation.

16. The portable supporting frame, as recited in claim 12, wherein said leg frame further comprises a stopper arm having two ends coupled with said second crossed legs to bias against said first crossed legs at said set up position so as to stop a further pivot movement of each of said first crossed legs at said set up position, wherein said control member is pivotally coupled with said stopper arm, such that said stopper arm not only forms a stopper to retain said first and second crossed legs at said setup position but also forms a support to support said control member underneath the tabletop frame.

17. The portable supporting frame, as recited in claim 15, wherein said leg frame further comprises a stopper arm having two ends coupled with said second crossed legs to bias against said first crossed legs at said set up position so as to stop a further pivot movement of each of said first crossed legs at said set up position, wherein said control member is pivotally coupled with said stopper arm, such that said stopper arm not only forms a stopper to retain said first and second crossed legs at said setup position but also forms a support to support said control member underneath the tabletop frame.

* * * * *